US011505959B2

(12) United States Patent
Tailleur et al.

(10) Patent No.: US 11,505,959 B2
(45) **Date of Patent: *Nov. 22, 2022**

(54) SWIMMING-POOL CLEANING APPARATUS COMPRISING MEANS FOR ADJUSTING THE PRESSURE INSIDE SAID APPARATUS

(71) Applicant: ZODIAC POOL CARE EUROPE, Bron (FR)

(72) Inventors: Philippe Blanc Tailleur, Toulouse (FR); Louis Favie, Villeneuve de Riviere (FR); Thierry Michelon, Toulouse (FR); Philippe Pichon, Toulouse (FR)

(73) Assignee: ZODIAC POOL CARE EUROPE, Belberaud (FR)

( * ) Notice: Subject to any disclaimer, the term of this patent is extended or adjusted under 35 U.S.C. 154(b) by 336 days.

This patent is subject to a terminal disclaimer.

(21) Appl. No.: 16/780,556

(22) Filed: Feb. 3, 2020

(65) Prior Publication Data

US 2020/0165832 A1 May 28, 2020

Related U.S. Application Data

(63) Continuation of application No. 15/764,650, filed as application No. PCT/FR2016/052460 on Sep. 28, 2016, now Pat. No. 10,597,887.

(30) Foreign Application Priority Data

Oct. 2, 2015 (FR) ..... 1559372

(51) Int. Cl.
*E04H 4/16* (2006.01)
*B08B 3/14* (2006.01)

(52) U.S. Cl.
CPC ..... *E04H 4/1654* (2013.01); *B08B 3/14* (2013.01)

(58) Field of Classification Search
CPC ..... E04H 4/1654; B08B 3/14
See application file for complete search history.

(56) References Cited

U.S. PATENT DOCUMENTS 8,394,266 B2 3/2013 Pichon et al.
10,597,887 B2 3/2020 Tailleur et al.

FOREIGN PATENT DOCUMENTS

CN 203640340 6/2014
EP 1022411 7/2000
(Continued)

OTHER PUBLICATIONS

U.S. Appl. No. 15/764,650, Corrected Notice of Allowability dated Jan. 8, 2020, 4 pages.
(Continued)

*Primary Examiner* — David Redding
(74) *Attorney, Agent, or Firm* — Kilpatrick Townsend & Stockton LLP

(57) ABSTRACT

The invention relates to a swimming-pool cleaning apparatus which comprises: a body; at least one hydraulic circuit for circulating liquid between at least one liquid intake and at least one liquid outlet, and through a filtering device of the cleaning apparatus; a fluid-circulation pump installed in the hydraulic circuit downstream from the filtering device; means for adjusting the pressure inside the hydraulic circuit upstream from the circulation pump, in response to a detected variation of said pressure, said pressure-adjustment means comprising: at least one secondary liquid intake (21) connected to the hydraulic circuit, upstream from the circulation pump, said at least one secondary liquid intake (21) being provided with a valve (22) mounted rotatably movable about an axis of rotation, and with means for driving the valve from an open position to a closed position, said means for driving the valve comprising a float (26), the orientation
(Continued)

and/or the force of which depend on the orientation of the cleaning apparatus relative to a horizontal plane.

7 Claims, 5 Drawing Sheets

(56) References Cited

FOREIGN PATENT DOCUMENTS

| | | |
|---|---|---|
| EP | 3356621 | 11/2019 |
| FR | 2929311 | 10/2009 |

OTHER PUBLICATIONS

U.S. Appl. No. 15/764,650, Notice of Allowance dated Nov. 5, 2019, 10 pages.
International Application No. PCT/FR2016/052460, International Preliminary Report on Patentability dated Apr. 3, 2018, 12 pages (5 pages of English Translation and 7 pages of Original Document).
International Application No. PCT/FR2016/052460, International Search Report and Written Opinion dated Dec. 5, 2016, 16 pages (7 pages of English Translation and 9 pages of Original Document).
Australian Application No. 2016333560, Notice of Acceptance dated May 11, 2021, 3 pages.
Australia Application No. 2016333560, First Examination Report dated Mar. 23, 2021, 3 pages.

SWIMMING-POOL CLEANING APPARATUS COMPRISING MEANS FOR ADJUSTING THE PRESSURE INSIDE SAID APPARATUS

This application is a continuation of allowed U.S. patent application Ser. No. 15/764,650 ("the '650 application"), filed Mar. 29, 2018, entitled "SWIMMING-POOL CLEANING APPARATUS COMPRISING MEANS FOR ADJUSTING THE PRESSURE INSIDE SAID APPARATUS," which is a national phase entry under 35 USC § 371 of International Application No. PCT/FR2016/052460 ("the '460 application"), filed Sep. 28, 2016, and entitled "SWIMMING-POOL CLEANING APPARATUS COMPRISING MEANS FOR ADJUSTING THE PRESSURE INSIDE SAID APPARATUS," which claims priority to and benefits of French Patent Application No. 1559372 ("the '372 application"), filed Oct. 2, 2015, entitled "SWIMMING-POOL CLEANING APPARATUS COMPRISING MEANS FOR ADJUSTING THE PRESSURE INSIDE SAID APPARATUS." The '650 application, the '460 application, and the '372 application are hereby incorporated in their entireties by this reference.

The present invention relates to the field of swimming pool equipment. It more particularly concerns autonomous swimming pool cleaning apparatus of the robot type.

PREAMBLE AND PRIOR ART

The invention concerns apparatus for cleaning a surface submerged in a liquid, such as a surface formed by the walls of a pool, notably a swimming pool. This refers in particular to a mobile swimming pool cleaning robot. A cleaning robot of this kind executes said cleaning by travelling over the bottom and the walls of the swimming pool, brushing those walls and drawing the debris toward a filter. The term debris designates all particles present in the pool, such as fragments of leaves, microalgae, etc., these debris normally being deposited on the bottom of the pool or stuck to its side walls.

The robot is most usually fed with energy by an electrical cable connecting the robot to an exterior control and power supply unit.

There is known in this field, for example, the applicant's patent FR 2 929 311, which is directed to submerged surface cleaning apparatus with pump pressure regulation. Devices of this kind comprise a body, members for driving said body over the submerged surface, a filter chamber formed inside the body and including a liquid inlet, a liquid outlet, and a liquid circulation hydraulic circuit between the inlet and the outlet and through a filter device. In these two patents, the filter device is removable to enable it to be emptied of the leaves and other debris without having to turn over the cleaning apparatus.

These apparatus have programs for automatic cleaning of the bottom of the pool and where applicable the side walls of the pool. A program of this kind determines cleaning of the swimming pool in a predetermined time, for example an hour and a half. The robot is generally removed from the water by the user to clean it at the end of the cycle or at regular intervals, if the filter is too full of particles (leaves, microparticles, etc.). In recent designs, the exterior robot control and power supply unit emits a luminous signal when this operation of cleaning the filter has to be carried out.

Some of these cleaning robots are adapted also to clean the vertical walls of the swimming pool. It has been observed that these robots frequently have difficulty in climbing up these walls when their filter is laden with cleaning debris. This difficulty in climbing the walls then compromises good cleaning of the swimming pool.

An aim of the invention is in particular to remedy this disadvantage.

SUMMARY OF THE INVENTION

A first aspect of the invention is directed to swimming pool cleaning apparatus comprising:

- a body,
- at least one hydraulic circuit for circulating liquid between at least one liquid inlet and at least one liquid outlet and through a filtration device of the cleaning apparatus,
- a fluid circulation pump installed in the hydraulic circuit downstream of the filtration device.

The apparatus also includes:

- means for adjusting the pressure in the hydraulic circuit upstream of the circulation pump in response to a detected variation of this pressure.

The means for adjusting the pressure comprise:

- at least a secondary liquid inlet connected to the hydraulic circuit upstream of the circulation pump, said at least a secondary liquid inlet being equipped with a valve mounted rotatably about an axis of rotation, and with means for moving the valve from an opened position to a closed position,
- said means for moving the valve comprising a float the orientation and/or the force of which is a function of the orientation of the cleaning apparatus relative to a horizontal plane.

The expression "swimming pool cleaning apparatus" denotes apparatus for cleaning a submerged surface, that is to say typically apparatus mobile in or on the bottom of a swimming pool, and adapted to filter debris deposited as much on the bottom as on a wall. Apparatus of this kind is commonly known as a swimming pool cleaning robot when it includes means for automatic management of the movements over the bottom and the walls of the swimming pool to cover all of the surface to be cleaned.

Although an abuse of language, here the term "liquid" denotes the mixture of water and debris in suspension in the swimming pool or in the fluid circulation circuit in the cleaning apparatus.

In the present text, by "opened position" and "closed position" is meant that the valve occupies a position in which it respectively opens and closes at least a secondary liquid inlet.

In one embodiment of the invention, the means for adjusting the pressure comprise means for moving the valve from an opened position to a closed position, said means for moving the valve comprising a return spring of which the force is predetermined.

In an embodiment enabling a substantially unchanged pressure to be maintained when the robot climbs up a wall, thus facilitating its ascent, the means for adjusting the pressure are active when the apparatus is subjected to an inclination greater than a predetermined value.

Clearly the aim here is to obtain a flow rate that is constant or greater than the minimum flow rate necessary for the robot to climb up a vertical wall. Actually, a minimum pump flow rate is necessary to ensure that the robot is pressed correctly onto the wall and thus to enable its wheels to drive it up that wall. This pump flow rate is directly reflected in the pressure difference between the zone upstream of the pump but downstream of the filter and the exterior of the body of the robot. A low flow rate means that the pump is aspirating little water and therefore creating a small pressure reduction in the body of the robot. To the contrary, a high pump flow rate means that the pump is aspirating a great deal of water and creating a large pressure reduction in the body of the robot.

Knowing the pressure in the zone situated upstream of the pump but downstream of the filter is therefore sufficient to determine the flow rate of the pump, which is an important control variable here.

In another embodiment optionally combined with the previous one, the means for adjusting the pressure are active when the filter of the apparatus has a degree of clogging greater than a predetermined threshold.

In one particular embodiment, the return spring has sufficient stiffness to keep the valve closed, in spite of the vertical force for opening the valve that is linked with the partial vacuum upstream of the circulation pump.

With the object of warning a user of the apparatus of the degree of clogging of the filter, in one particular embodiment, the cleaning apparatus includes means for detecting the complete opening of the valve and means for communicating a need for cleaning the filter to a user of the apparatus.

In one particular embodiment, the swimming pool cleaning apparatus also includes:

- means for measuring the pressure in the hydraulic circuit upstream of the circulation pump,
- at least a secondary liquid inlet connected to the hydraulic circuit upstream of the circulation pump and equipped with a valve having an opened position and a closed position,
- means for controlling the opening of said valve according to the pressure measured in the hydraulic circuit upstream of the circulation pump.

The invention is also directed to a method of controlling the described swimming pool cleaning apparatus, the method comprising a step of moving the valve so as to keep the pressure measured in the hydraulic circuit upstream of the circulation pump equal to a pre-chosen value.

It is therefore apparent that when the valve is closed, water is aspirated via the main water inlet, which enables normal collection of debris deposited on the wall. On the contrary, when the valve is open, maintaining the flow rate of the pump above a certain threshold enables the movement of the robot to be maintained, in particular on a vertical wall, although this reduces the suction capacity on said wall.

The invention also concerns submerged surface cleaning apparatus characterized in combination by any or all of the features referred to above or hereinafter.

DESCRIPTION OF THE FIGURES

The features and advantages of the invention will be better understood thanks to the following description, which describes the features of the invention by way of a nonlimiting example of its application.

The description is supported by the appended figures in which.

DETAILED DESCRIPTION OF ONE EMBODIMENT OF THE INVENTION

The invention finds its application in a swimming pool technical environment, for example a family type subsurface swimming pool.

In the present embodiment, a submerged surface cleaning system includes cleaning apparatus 10, referred to hereinafter as a swimming pool cleaning robot, and a power supply and control unit of said swimming pool cleaning robot (not shown in the figures). In a variant, this power supply and control unit can be integrated into the cleaning apparatus.

Figure 1:
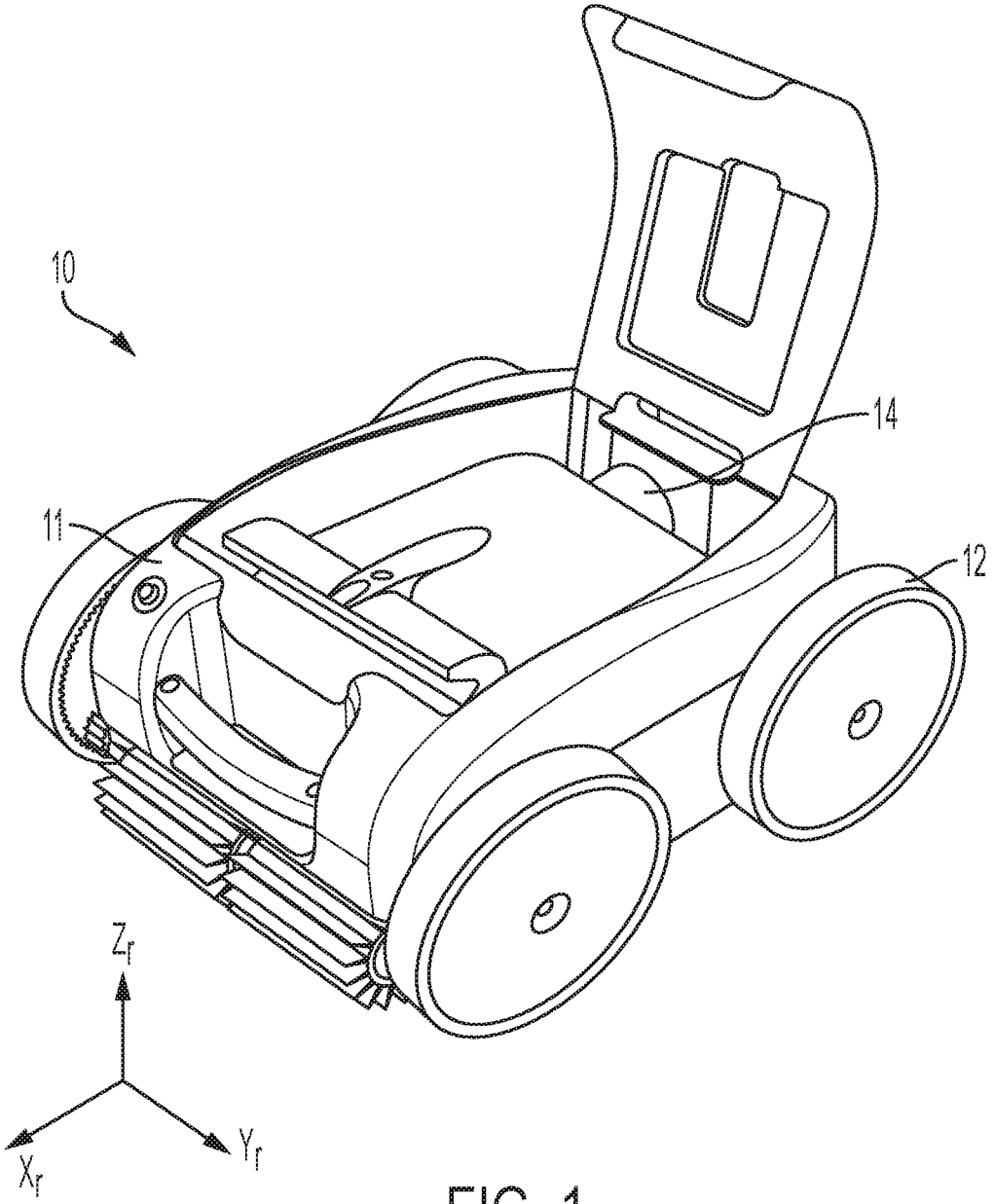
FIG. 1 is a perspective view of swimming pool cleaning apparatus employing the described filter system.
Figure 2:
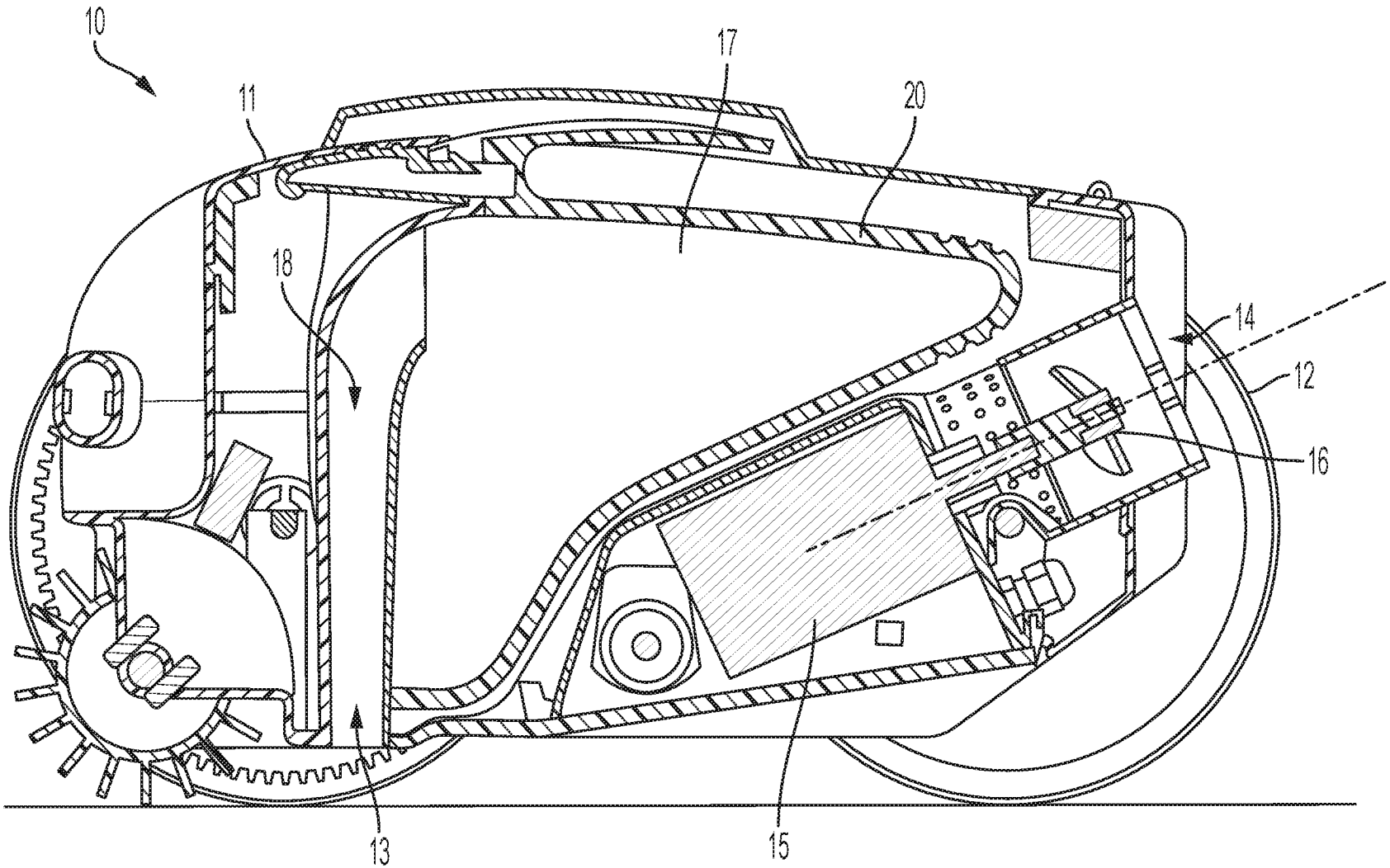
FIG. 2 is a sectional view of the same apparatus on a vertical longitudinal plane.

The cleaning apparatus 10 is represented in FIGS. 1 and 2 in accordance with an embodiment given here by way of example. In these figures, the apparatus is of the type using inclined ejection of water toward the rear of the apparatus relative to the plane on which the robot is rolling.

The swimming pool cleaning apparatus comprises a body 11 and members 12 for driving and guiding the body 11 over a submerged surface. In the present example, these drive and guide members 12 comprise wheels disposed at the sides of the body (see FIG. 1).

The drive and guide members define a guide plane over a submerged surface by their points of contact with said submerged surface. Said guide plane is generally substantially tangential to the submerged surface at the point at which the apparatus is located. Said guide plane is for example substantially horizontal when the apparatus moves over a swimming pool submerged bottom surface.

Throughout the text the concepts "top" and "bottom" are defined along a straight line segment perpendicular to said guide plane, a "bottom" element being closer to the guide plane than a top element.

The swimming pool cleaning apparatus either comprises a motor driving said drive and guide members, said motor being in the present example supplied with energy by the control and command unit via a watertight flexible cable.

The swimming pool cleaning apparatus has at least one liquid inlet 13 and one liquid outlet 14. The liquid inlet 13 is situated at the bottom of the body (in other words under it), that is to say immediately facing a submerged surface over which the apparatus is moved in order to be able to aspirate the debris accumulated on said submerged surface.

Here the liquid outlet 14 is located on the lid at the rear of the apparatus. In the present example, the liquid exits in a direction oriented toward the rear of the apparatus. This arrangement is in no way limiting, however, and a water outlet substantially perpendicular to the guide plane, that is to say vertical if the cleaning apparatus is resting on the bottom of the swimming pool, can equally be envisaged.

The apparatus comprises a hydraulic circuit connecting the liquid inlet 13 to the liquid outlet 14. The hydraulic circuit is adapted to be able to circulate liquid from the liquid inlet 13 to the liquid outlet 14. To this end the apparatus comprises a circulation pump comprising an electric motor 15 and an impeller 16 (see FIG. 2), said electric motor 15 driving the impeller 16 in rotation, said impeller 16 being disposed in the hydraulic circuit.

The apparatus comprises a filter chamber 17 in the hydraulic circuit between the liquid inlet 13 and the liquid outlet 14. The filter chamber is in particular fed with liquid via at least one upstream channel 18 connecting the liquid inlet 13 to the filter chamber 17.

The filter chamber 17 comprises a filter basket 20. This filter basket 20 is advantageously but not necessarily removable.

Figure 3:
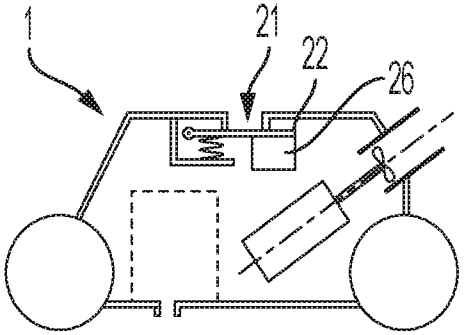
FIG. 3 is a diagrammatic sectional view of the same apparatus having a secondary water inlet having a valve.

In the embodiment described here by way of example, the swimming pool cleaning apparatus further includes, in addition to the liquid inlet 13 already mentioned, at least one secondary liquid inlet 21 (see FIG. 3). This secondary liquid inlet 21 is equipped with a valve 22.

Here the secondary liquid inlet 21 is placed at the level of the upper surface of the body 11 of the cleaning robot 10, which reduces the density of debris floating in the swimming pool in front of said secondary inlet 21, in particular compared to the liquid inlet 13 located on the lower face of the same robot. This secondary inlet 21 can however be placed on another face of this cleaning robot instead.

This secondary liquid inlet 21 is also connected to the hydraulic circuit, upstream of the circulation pump. As a result, it is possible to feed more or less water into the circulation pump via the secondary inlet 21.

The valve 22 is preferably continuous in shape with the exterior surface of the body 11 of the cleaning robot 10 when it is in the closed position. Here it is of substantially plane shape.

In the present embodiment, shown in FIGS. 3 to 10, the valve 22 is articulated in rotation about a rotation axis 23. A return spring 24 urges the valve 22 toward a closed position (pressed against the secondary liquid inlet 21 provided in the body 11 of the robot). In the present example, this return spring 24 is disposed perpendicularly to the second liquid inlet 21 to be blocked, and comes to bear on the valve between the secondary liquid inlet 21 and the rotation axis 23.

Finally the valve is fastened to a float 26, disposed here at the end of the valve opposite the rotation axis 23.

Figure 4:
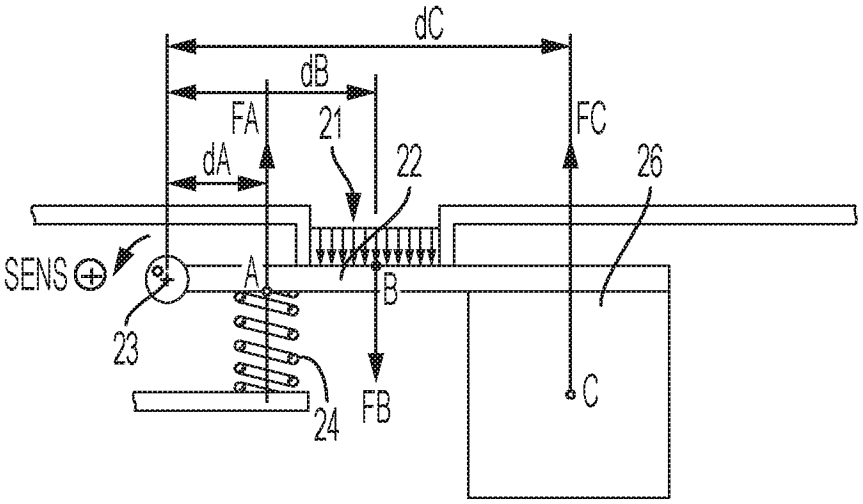
FIG. 4 shows diagrammatically the operating principle of the valve when the robot is in a horizontal position.
Figure 6:
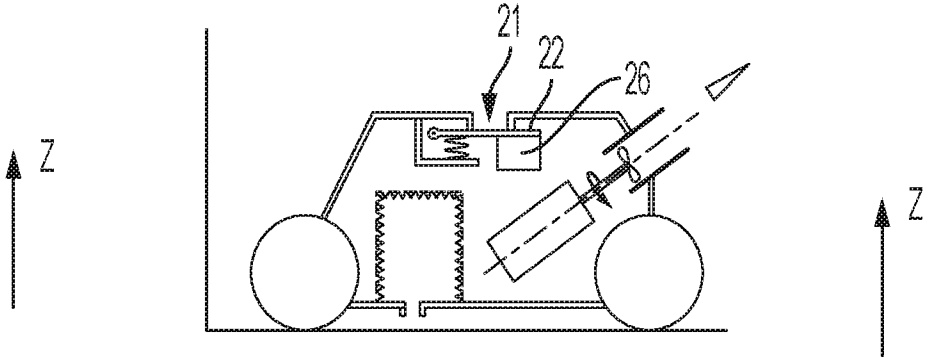
FIG. 6 shows the same situation as FIG. 5 with a clogged filter.

In the remainder of the description, dA denotes the distance between the rotation axis 23 and the point on which the return spring 24 bears (see FIG. 4).

Likewise, dB denotes the distance between the rotation axis 23 and the center of the secondary liquid inlet 21. Here that center is defined as the center of gravity of the shape of the liquid inlet.

Figure 10:
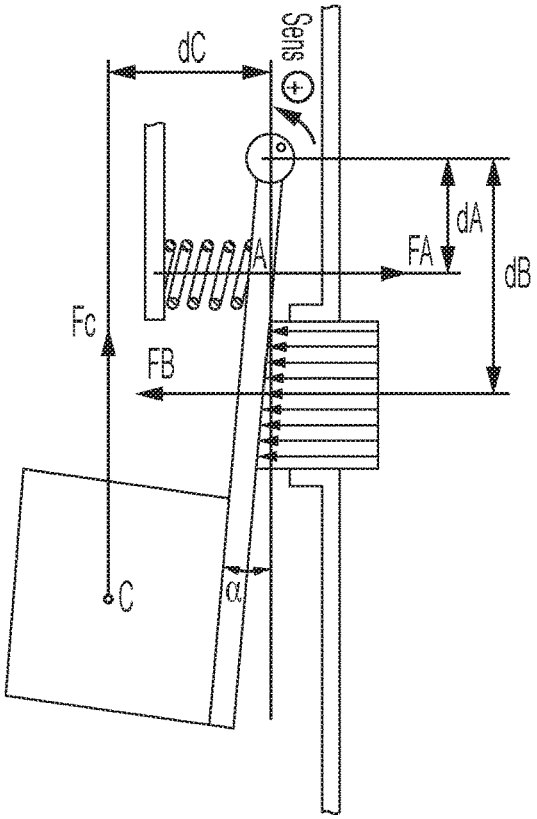
FIG. 10 shows diagrammatically the operating principle of the valve when the robot is in a vertical position, with the filter clogged, with the valve partially open.

Likewise, dC denotes the distance between the rotation axis 23 and the center of thrust of the float 26, this distance being measured perpendicularly to the vertical (see FIGS. 4 and 10 for example). Here this center of thrust is defined as the center of gravity of the shape of said float 26.

$F_A$ denotes the return force toward its closed position exerted on the valve by the return spring 24. $F_B$ denotes the thrust force toward its opened position exerted on the valve by the secondary liquid inlet 21 when a partial vacuum exists in the interior of the filter chamber 17, because of the action of the circulation pump 16. $F_C$ denotes the thrust force exerted by the float 26 on the valve in a vertical direction, because of the action of the Archimedes force.

The valve 22 can be opened or closed depending on the combination of the moments of the forces $F_A$, $F_B$, $F_C$ exerted around the rotation axis 23.

MODE OF OPERATION

Figure 5:
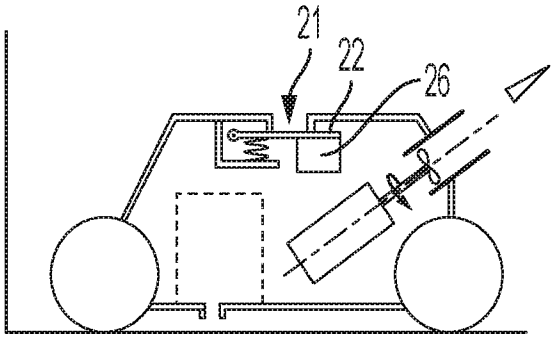
FIG. 5 shows the circulation of water in the cleaning robot when said robot is in a horizontal position with a filter that is not clogged.

In the present embodiment, when the robot begins to operate, the filter 20 is initially free of debris, the pressure in the hydraulic circuit upstream of the circulation pump 16 assumes a first value linked to the suction created by said circulation pump, and the situation is that shown in FIG. 5. As can be seen in that figure, the valve 22 remains closed. The resultant of the moments exerted on the valve 22 is written: $F_A \times dA + F_C \times dC1 \geq F_{B1} \times dB$.

As the cleaning robot operates, the filter 20 of that apparatus is progressively filled with debris floating in the water of the swimming pool or deposited on the bottom of the latter. Because of this, progressive clogging of the filter leads to a reduction of pumping power, which is reflected in a progressively partial vacuum in the hydraulic circuit upstream of the filter. The force $F_{B1}$ increases and assumes a value $F_{B2}$. The situation is then that shown in FIG. 6. As can be seen in that figure, the valve 22 also remains closed. Actually, the return spring 24 is calibrated here to have a stiffness sufficient to keep the valve 22 closed in spite of the vertical force $F_{B2}$ linked to the partial vacuum existing upstream of the circulation pump 16. In other words: $F_A \times dA + F_C \times dC1 \leq F_{B2} \times dB$. The lever arm $F_C \times dC1$ exerted by the float 26 here reinforces the lever arm $F_A \times dA$ exerted by the force $F_A$ generated by the spring to keep the valve 22 closed.

The circulation of water in the circulation pump 17 is then reduced because of the partial clogging of the filter.

Figure 7:
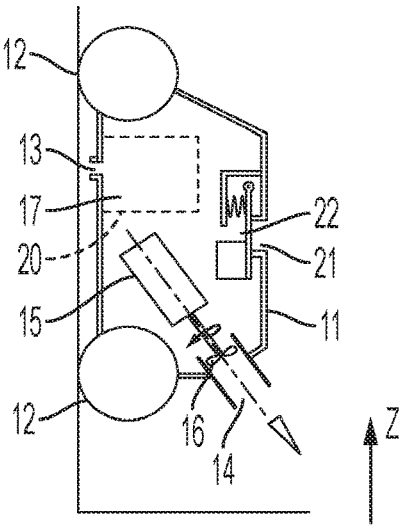
FIG. 7 shows the circulation of water in the cleaning robot when said robot is in a vertical position on a wall with a filter that is not clogged.
Figure 8:
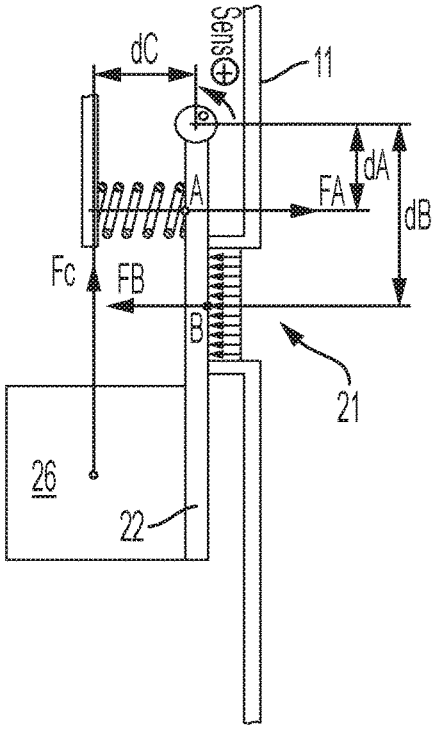
FIG. 8 shows diagrammatically the operating principle of the valve when the robot is in a vertical position, with the filter not clogged, with the valve closed.

FIG. 7 shows the same operation of the robot when the latter climbs up a vertical wall, typically a side wall of the swimming pool, in the situation where the filter is not yet laden with debris. In this situation, the pressure upstream of the circulation pump 16 is normal and water from the swimming pool enters the hydraulic circuit only via the liquid inlet 13. FIG. 8 then shows in detail the situation at the level of the valve 22. In this situation, the force exerted by the float 26 is directed toward the local vertical, that is to say perpendicular to the other two forces. The lever arm $F_C \times dC2$ exerted by this float 26 is significantly reduced compared to the situation of horizontal operation of the robot (the distance dC2 being significantly less than the distance dC1), and is in the opposite direction, so that here it reinforces the lever arm $F_{B1} \times dB$ exerted by the force $F_{B1}$ generated by the partial vacuum in the body of the robot, and therefore tends to facilitate opening of said valve 22. However the return spring 24 is calibrated so that the valve remains closed in this situation. Here the situation is therefore one in which the resultant of the moments is written: $F_A \times dA \geq F_{B1} \times dB + F_C \times dC2$.

Figure 9:
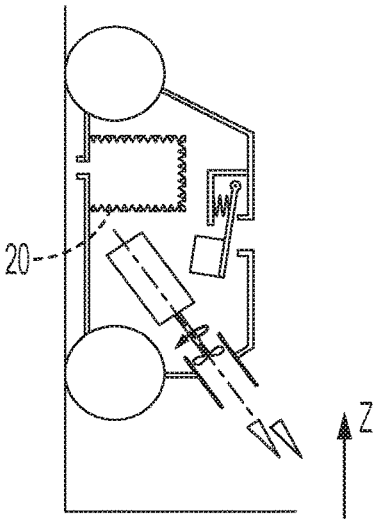
FIG. 9 shows the same situation as FIG. 8 with a clogged filter.

When the filter 20 is laden with debris, the pressure is further reduced in the hydraulic circuit between the filter chamber 17 and the circulation pump 16. This situation is shown in FIGS. 9 and 10. In this case, the pressure is significantly reduced upstream of the circulation pump 16, and the value of the force $F_{B2}$ created by this partial vacuum is therefore significantly increased relative to the situation of a filter that is not clogged. Then $F_A \times dA < F_{B2} \times dB + F_C \times dC2$. The force produced by the float being initially vertical when the valve 22 is closed, the latter is opened by the effect of the resultant of the moments exerted on it. The lever arm exerted by the float 26 then increases as the horizontal distance between the rotation axis 23 and the center of thrust of the float dC2 increases and assumes the value dC3. In this situation, the float 26 increases the opening of the valve 22 and water enters into the hydraulic circuit and therefore comes to increase the pressure existing in said circuit upstream of the circulation pump 16. The valve 22 then comes to assume an equilibrium partially opened position in which the lever arm generated by the force exerted by the pressure of the water is just counterbalanced by the lever arms of the return spring 24 and the float 26.

Beyond a predetermined value of the degree of clogging of the filter 20, which determines a large reduction of pressure in the hydraulic circuit upstream of the pump 16, the valve 22 comes to assume a completely opened position. In the present example, in this case a visual display is triggered on the power supply and control unit to alert the user to an imminent need to clean the filter.

The above considerations have been described in detail for a valve 22 disposed under a horizontal opening. The modification of these equations in the situation where the secondary liquid inlet is disposed on an inclined wall instead of a horizontal wall will be obvious to a person skilled in the art. It is therefore not described further here.

Variants

In a variant embodiment, the device includes no float 26 and the valve 22 opens when the filter 20 is clogged, independently of the vertical or horizontal attitude of the body 11 of the cleaning robot 10.

In a variant embodiment, the valve 22 includes automatic opening means responding to a predetermined partial vacuum threshold in the hydraulic circuit between the filter chamber 17 and the circulation pump 16. This threshold typically corresponds to a predetermined level of soiling of the filter 20.

In a variant embodiment, the cleaning apparatus 10 moreover includes means for measuring the pressure of the liquid in the hydraulic circuit upstream of the circulation pump. These means for measuring are of a kind known in themselves to a person skilled in the art. They comprise for example means for measuring the electrical current at the terminals of the circulation pump 16.

The cleaning apparatus then advantageously includes means for controlling the opening of the valve 22 in accordance with the measurements of the pressure in the hydraulic circuit. The opened or closed position of the valve 22 can advantageously be remotely controlled, for example via the power supply and control unit. The position of the valve 22 can optionally be adjusted to any position between a completely opened position and a completely closed position.

Figure 11:
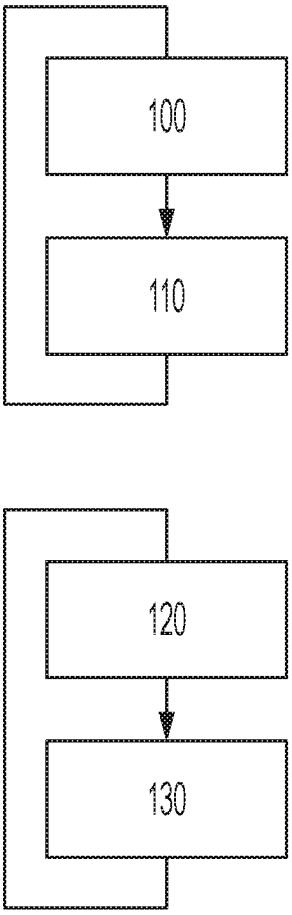
FIG. 11 is a flowchart of a method of using the invention in one application of the invention.

In this variant, the method of controlling the swimming pool cleaning apparatus, as shown in FIG. 11, includes a step 100 of recurrent acquisition of measurements of the pressure in the hydraulic circuit upstream of the circulation pump and a step 110 of modification of the opening of the valve 22 as a function of that pressure measurement, for example to maintain the pressure constant at a constant pre-chosen value.

In a variant, the cleaning apparatus 10 also includes means for detecting the attitude of said apparatus, notably for detecting its angular position relative to a horizontal plane. These means are known in themselves. They can for example be an accelerometer or a gyroscope.

In this variant embodiment, the method also comprises a recurrent step 120 of surveillance of the cleaning robot in the process of travelling over a vertical wall, thanks to the means for detecting the attitude, and a step 130 of opening the valve 22 in this situation, to facilitate the cleaning robot 10 climbing up the wall, and to maintain constant the aspiration pressure in the hydraulic circuit, even if the filter 20 starts to become clogged.

In another variant embodiment, the device comprises only a float 26 and does not have a return spring. In this case, the float 26 is disposed and sized so that it closes the valve 22 when the filter 20 is not clogged and allows water to enter via the secondary liquid inlet 21 if the filter 20 is clogged beyond a certain threshold or when the robot 10 is oriented vertically.

The invention claimed is:

1. Swimming pool cleaning apparatus comprising:

a. a body comprising a liquid inlet and a liquid outlet;

b. a filtration device;

c. a hydraulic circuit for circulating liquid between the liquid inlet and the liquid outlet and through the filtration device;

d. a fluid circulation pump installed in the hydraulic circuit downstream of the filtration device; and e. means for adjusting the pressure in the hydraulic circuit upstream of the fluid circulation pump in response to a detected variation of this pressure, said means comprising a secondary liquid inlet connected to the hydraulic circuit upstream of the fluid circulation pump, said secondary liquid inlet being equipped with a valve configured to move from an opened position to a closed position as a function of an orientation of the body relative to a horizontal plane.

2. The swimming pool cleaning apparatus of claim 1, further comprising a float for moving the valve from the opened position to the closed position.

3. The swimming pool cleaning apparatus of claim 1, wherein the valve is rotatably mounted about an axis of rotation.

4. The swimming pool cleaning apparatus of claim 1, further comprising a return spring for moving the valve from the opened position to the closed position.

5. The swimming pool cleaning apparatus of claim 1, wherein the means for adjusting the pressure is active when the apparatus is subjected to an inclination greater than a predetermined value.

6. The swimming pool cleaning apparatus of claim 1, wherein the means for adjusting the pressure is active when a filtration level of the filtration device exceeds a predetermined threshold.

7. The swimming pool cleaning apparatus of claim 1, further comprising means for detecting when the valve is in the opened position and means for communicating a need for cleaning the filtration device to a user.

* * * * *